US006221824B1

(12) United States Patent
Lietzmann et al.

(10) Patent No.: US 6,221,824 B1
(45) **Date of Patent: *Apr. 24, 2001**

(54) PROCESS FOR THE PRODUCTION OF COMPOUNDED ACETONITRILE DERIVATIVES

(75) Inventors: Andreas Lietzmann; Artiga Gonzalez; Stefan Hammelstein; Christian Nitsch, all of Duesseldorf; Horst-Dieter Speckmann, Langenfeld, all of (DE)

(73) Assignee: Henkel Kommanditgesellschaft auf Aktien, Duesseldorf (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/513,409

(22) Filed: Feb. 25, 2000

(30) Foreign Application Priority Data

Feb. 25, 1999 (DE) ..... 199 08 051

(51) Int. Cl.[7] ..... C11D 3/395; C11D 3/28; C11D 13/20

(52) U.S. Cl. ..... 510/314; 510/444; 510/445; 510/446; 510/220; 510/224; 510/302; 510/309; 510/310; 510/311; 510/312; 510/313; 510/314; 510/367; 510/531; 510/532; 510/534; 544/163; 544/164; 544/159

(58) Field of Search ..... 510/444, 445, 510/446, 220, 224, 302, 309, 310, 311, 312, 313, 314, 367, 531, 532, 534; 544/163, 164, 159

(56) References Cited

U.S. PATENT DOCUMENTS

| | | | | |
|---|---|---|---|---|
| 5,002,681 | * | 3/1991 | Wierenga et al. | 252/90 |
| 5,167,852 | * | 12/1992 | Emery et al. | 252/95 |
| 5,281,361 | * | 1/1994 | Adams et al. | 252/786.38 |
| 5,419,846 | * | 5/1995 | Jaekel et al. | 252/95 |
| 5,451,354 | * | 9/1995 | Aouad et al. | 264/117 |
| 5,494,599 | * | 2/1996 | Goovaerts et al. | 252/89.1 |
| 5,663,136 | * | 9/1997 | Van Dijk et al. | 510/444 |
| 5,712,242 | * | 1/1998 | Aouad et al. | 510/444 |
| 5,716,569 | * | 2/1998 | Berenbold et al. | 264/115 |
| 5,739,327 | * | 4/1998 | Arbogast et al. | 544/163 |
| 5,888,954 | | 3/1999 | Haerer et al. | 510/226 |
| 5,898,025 | | 4/1999 | Burg et al. | 510/229 |
| 5,962,397 | * | 10/1999 | Ridyard et al. | 510/443 |
| 6,075,001 | | 6/2000 | Wilde | 510/376 |

FOREIGN PATENT DOCUMENTS

| | | | |
|---|---|---|---|
| 43 15 397 | | 11/1994 | (DE) . |
| 43 25 922 | | 2/1995 | (DE) . |
| 44 16 438 | | 11/1995 | (DE) . |
| 44 43 177 | | 6/1996 | (DE) . |
| 195 18 693 | | 11/1996 | (DE) . |
| 195 29 905 | | 2/1997 | (DE) . |
| 195 36 082 | | 4/1997 | (DE) . |
| 196 05 688 | | 8/1997 | (DE) . |
| 196 13 103 | | 10/1997 | (DE) . |
| 196 20 411 | | 10/1997 | (DE) . |
| 196 16 693 | | 11/1997 | (DE) . |
| 196 16 767 | | 11/1997 | (DE) . |
| 196 16 769 | | 11/1997 | (DE) . |
| 196 16 770 | | 11/1997 | (DE) . |
| 196 20 267 | | 11/1997 | (DE) . |
| 0 272 030 | | 6/1988 | (EP) . |
| 0 392 592 | | 10/1990 | (EP) . |
| 0 443 651 | | 8/1991 | (EP) . |
| 0 446 982 | | 9/1991 | (EP) . |
| 0 453 003 | | 10/1991 | (EP) . |
| 0 458 397 | | 11/1991 | (EP) . |
| 0 458 398 | | 11/1991 | (EP) . |
| 464880 | * | 1/1992 | (EP) . |
| 0 525 239 | | 2/1993 | (EP) . |
| 0 544 490 | | 6/1993 | (EP) . |
| 0 544 519 | | 6/1993 | (EP) . |
| 0 549 271 | | 6/1993 | (EP) . |
| 0 549 272 | | 6/1993 | (EP) . |
| 0 693 550 | | 1/1996 | (EP) . |
| WO 92/11347 | | 7/1992 | (WO) . |
| WO 94/02597 | | 2/1994 | (WO) . |
| WO 94/02618 | | 2/1994 | (WO) . |
| WO 94/05762 | | 3/1994 | (WO) . |
| WO 94/07981 | | 4/1994 | (WO) . |
| WO 94/18314 | | 8/1994 | (WO) . |
| WO 94/19445 | | 9/1994 | (WO) . |
| WO 94/23005 | | 10/1994 | (WO) . |
| WO 94/23053 | | 10/1994 | (WO) . |
| WO 94/25597 | | 11/1994 | (WO) . |
| WO 94/27970 | | 12/1994 | (WO) . |
| WO 94/28102 | | 12/1994 | (WO) . |
| WO 94/28103 | | 12/1994 | (WO) . |
| WO 95/00626 | | 1/1995 | (WO) . |
| WO 95/07350 | | 3/1995 | (WO) . |

(List continued on next page.)

*Primary Examiner*—Yogendra Gupta
*Assistant Examiner*—Charles Boyer
(74) *Attorney, Agent, or Firm*—Wayne C. Jaeschke; Glenn E. J. Murphy

(57) ABSTRACT

The storage stability of bleach-activating acetonitrile derivatives in solid detergent compositions was to be improved. This was essentially achieved by the use of compounded compounds corresponding to formula $R^1R^2R^3N^xCH_2CN\ X^-$, in which $R^1$, $R^2$ and $R^3$ independently of one another represent an alkyl, alkenyl or aryl group containing 1 to 18 carbon atoms, in addition to which the groups $R^2$ and $R^3$ may even be part of a heterocycle including the N atom and optionally other hetero atoms, and X is a charge-equalizing anion. "Compounds" of this type are produced by drying in vacuo, for which purpose a suspension of the acetonitrile derivative and a solid carrier material is introduced into a mixer and the resulting mixture is dried with superheated vapor. Dishwashing detergents, more particularly machine dishwashing detergents, contain about 1% by weight to 10% by weight of this bleach boosting compound.

32 Claims, No Drawings

FOREIGN PATENT DOCUMENTS

| | | |
|---|---|---|
| WO 95/14075 | 5/1995 | (WO) . |
| WO 95/14759 | 6/1995 | (WO) . |
| WO 95/17498 | 6/1995 | (WO) . |
| WO 95/27775 | 10/1995 | (WO) . |
| WO 96/40661 | 12/1996 | (WO) . |
| WO 98/23719 | 6/1998 | (WO) . |

* cited by examiner

PROCESS FOR THE PRODUCTION OF COMPOUNDED ACETONITRILE DERIVATIVES

BACKGROUND OF THE INVENTION

This invention relates to a process for the production of compounded acetonitrile derivatives which may be used as activators for peroxygen compounds, more particularly inorganic peroxygen compounds, for bleaching colored soils on tableware and to dishwashing detergents containing activator compounds produced by this process.

Inorganic peroxygen compounds, more particularly hydrogen peroxide, and solid peroxygen compounds which dissolve in water with release of hydrogen peroxide, such as sodium perborate and sodium carbonate perhydrate, have long been used as oxidizing agents for disinfecting and bleaching purposes. The oxidizing effect of these substances in dilute solutions depends to a large extent on the temperature. For example, with $H_2O_2$ or perborate in alkaline bleaching liquors, soiled textiles are only bleached sufficiently quickly at temperatures above about 80° C. At lower temperatures, the oxidizing effect of the inorganic peroxygen compounds can be improved by the addition of so-called bleach activators, for which numerous proposals, above all from the classes of N- or O-acyl compounds, for example polyacylated alkylenediamines, more especially tetraacetyl ethylenediamine, acylated glycolurils, more especially tetraacetyl glycoluril, N-acylated hydantoins, hydrazides, triazoles, hydrotriazines, urazoles, diketopiperazines, sulfuryl amides and cyanurates, also carboxylic anhydrides, more especially phthalic anhydride, carboxylic acid esters, more especially sodium nonanoyloxy benzene-sulfonate, sodium isononanoyloxy benzenesulfonate, and acylated sugar derivatives, such as pentaacetyl glucose, have become known in the literature. By adding these substances, the bleaching effect of aqueous peroxide liquors can be increased to such an extent that substantially the same effects are obtained at temperatures of only around 60° C. as are obtained with the peroxide liquor alone at 95° C.

In the search to find energy-saving washing and bleaching processes, application temperatures well below 60° C., more particularly below 45° C. down to the temperature of cold water, have acquired increasing significance in recent years.

At these low temperatures, there is generally a discernible reduction in the effect of the hitherto known activator compounds. Accordingly, there has been no shortage of attempts to develop more effective activators for this temperature range, but so far to no real avail.

Another problem which particularly affects machine dishwashing detergents is the need to incorporate corrosion inhibitors for table silver in such detergents, particularly where the detergents contain the oxygen-based bleaching or oxidizing agents which have recently become more widespread. During the dishwashing process, silver is capable of reacting with sulfur-containing substances dissolved or dispersed in the wash liquor, because food residues, including inter alia mustard, peas, egg and other sulfur-containing compounds, such as mercaptoamino acids, are introduced into the wash liquor in the cleaning of tableware in domestic dishwashing machines. The far higher temperatures prevailing during machine dishwashing and the longer contact times with the sulfur-containing food remains also promote the tarnishing of silver by comparison with manual dishwashing. In addition, the silver surface is completely degreased by the intensive cleaning process in the dishwashing machine and, as a result, becomes more sensitive to chemical influences.

The problem of tarnishing becomes acute in particular when active oxygen compounds, for example sodium perborate or sodium percarbonate, are used alternatively to the active chlorine compounds which oxidatively "deactivate" the sulfur-containing substances in order to eliminate bleachable soils, such as for example tea stains/tea films, coffee residues, dyes from vegetables, lipstick residues and the like.

Active oxygen bleaching agents of the type in question are used above all in modern low-alkalinity machine dishwashing detergents of the new generation, generally together with bleach activators. These detergents generally consist of the following functional components: builder component (complexing agent/dispersant), alkalinity source, bleaching system (combination of bleaching agent and bleach activator), enzyme and surfactant. Under the dishwashing conditions prevailing where detergents such as these are used, not only sulfidic coatings, but also oxidic coatings are generally formed on the silver surfaces—where silver is present—through the oxidizing effect of the peroxides formed as intermediates or the active oxygen.

It is known from International patent application WO 98/23719 that compounds corresponding to general formula I:

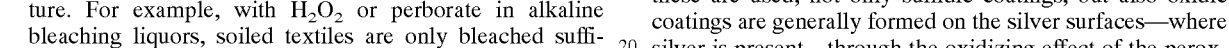

$$R^1R^2R^3N^+CH_2CN\ X^- \quad (I)$$

in which $R^1$, $R^2$ and $R^3$ independently of one another represent an alkyl, alkenyl or aryl group containing 1 to 18 carbon atoms, in addition to which the groups $R^2$ and $R^3$ may even be part of a heterocycle including the N atom and optionally other hetero atoms, and X is a charge-equalizing anion, can be used as activators for peroxygen compounds, more especially inorganic peroxygen compounds, in aqueous dishwashing solutions. An improvement in the oxidizing and bleaching effect of peroxygen compounds, more especially inorganic peroxygen compounds, at low temperatures below 80° C. and, more particularly, in the range from about 15° C. to 55° C. is achieved in this way. The compounds corresponding to general formula (I) are normally unstable in storage and, in particular, extremely sensitive to moisture, especially in combination with other ingredients of detergents. In the course of their production, some of the compounds of general formula (I) are obtained in liquid form, for example as aqueous solutions, and can only be converted from liquid form into the pure solid with considerable losses so that their use in solid detergents, for example particulate detergents, is problematical.

Accordingly, the problem addressed by the present invention was to provide a production process by which solutions containing a compound corresponding to general formula (I) could be converted into particulate preparations so that the active substance corresponding to formula (I) could be incorporated in solid detergents without any losses. It has now been found that preparations of the type in question, which are also referred to hereinafter as compounds, can be produced by vacuum vapor drying in a mixer. In this way, drying and granulation can be carried out in the one and the same unit.

DESCRIPTION OF THE INVENTION

The present invention relates to a process for the production of a particulate preparation containing a compound corresponding to general formula (I):

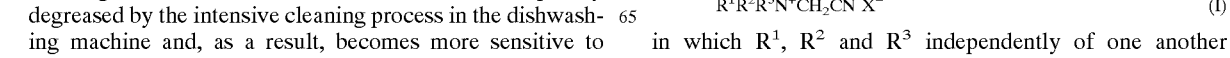

$$R^1R^2R^3N^+CH_2CN\ X^- \quad (I)$$

in which $R^1$, $R^2$ and $R^3$ independently of one another represent an alkyl, alkenyl or aryl group containing 1 to 18 carbon atoms, in addition to which the groups $R^2$ and $R^3$ may even be part of a heterocycle including the N atom and optionally other hetero atoms, and X is a charge-equalizing anion, characterized by the steps of a) introducing a suspension containing a solution of a compound corresponding to formula (I) in a solvent for that compound and a solid carrier material into a mixer, b) drying the suspension with superheated vapor under a pressure below 900 mbar and at a drying temperature of 40° C. to below 100° C., c) cooling the mixture to a temperature below the drying temperature and d) forming granules during the drying step or during the cooling of the mixture or the melt formed (if any).

The solid carrier material is preferably selected from the group consisting of alkali metal sulfates, alkali metal citrates, alkali metal phosphates, silicas, zeolites and mixtures thereof.

Compounds corresponding to formula I may be prepared by known methods, as published for example by Abraham in Progr. Phys. Org. Chem. 11 (1974), pages 1 et seq. or by Arnett in J. Am. Chem. Soc. 102 (1980), pages 5892 et seq., or by similar methods. Some compounds corresponding to general formula I are described in International patent application WO 96/40661.

It is particularly preferred to use compounds corresponding to formula I in which $R^2$ and $R^3$ form a morpholinium ring together with the quaternary nitrogen atom. In these compounds, $R^1$ is preferably an alkyl group containing 1 to 3 carbon atoms, more especially a methyl group.

The anions $X^-$ in the compounds of formula (I) include, in particular, the halides, such as chloride, fluoride, iodide and bromide, nitrate, hydroxide, hexafluorophosphate, sulfate, hydrogen sulfate, metho- and ethosulfate, chlorate, perchlorate and the anions of carboxylic acids, such as formate, acetate, benzoate or citrate. Compounds corresponding to formula I in which $X^-$ is sulfate, hydrogen sulfate or methosulfate are preferably used.

The process according to the invention may advantageously be carried out in an Eirich® mixer because a vacuum is easy to establish in mixers such as these. The pressure prevailing during the drying step is below 900 mbar, preferably below 750 mbar and more preferably in the range from 50 mbar to below 650 mbar. The temperature prevailing during the drying step is preferably in the range from 40 to 99° C. and more preferably in the range from 60 to 95° C. Where drying is carried out with superheated steam, the maximum pressure during the drying step is determined by the system pressure in accordance with the steam table. If the compound corresponding to formula (I) is present in a solvent other than water, more particularly in an organic solvent, drying may also be carried out with superheated solvent vapor. The expert will have no difficulty in choosing an appropriate solvent, the use of the solvent present in the compound corresponding to formula (I) being preferred. A solution containing 10 to 70% by weight and more particularly 40 to 60% by weight of the compound corresponding to formula (I) is preferably used. The addition of the carrier material (of the alkali metal salts mentioned, the sodium and/or potassium salts are preferred) to this solution gives a suspension containing preferably 0.1 part by weight to 10 parts by weight and more particularly 0.5 part by weight to 4 parts by weight carrier material to 1 part by weight of the compound corresponding to formula (I). After the drying step, the granules can be cooled by the addition of small quantities of a liquid, especially water. It is also possible and preferred to convert the mixture into a melt during the drying step so that granules are only formed during the cooling process. The term "melt" should be interpreted to mean that the mixture as a whole, particularly the carrier material, does not have to be melted, instead the compound corresponding to formula (I) is present in liquefied form by being heated to temperatures above its melting point.

An acetonitrile derivative corresponding to formula I converted into particulate form by the process according to the invention is preferably used in dishwashing solutions for bleaching colored stains. In the context of the present invention, the term bleaching is understood to encompass both the bleaching of soil present on the surface of the dishes, more especially tea, and the bleaching of soil present in the dishwashing liquor after detachment from the surface.

Accordingly, the present invention also relates to the use of particulate preparations obtainable by the process according to the invention for the production of solid detergents, more particularly dishwashing detergents.

The present invention also relates to solid dishwashing detergents, preferably machine dishwashing detergents, containing a compound which has been produced by the process described above and to the use of such a compound for the production of solid detergents.

The purpose according to the invention for which the compound is intended essentially comprises creating conditions—in the presence of a tableware surface soiled with colored soils—under which a peroxidic oxidizing agent and the bleach-activating acetonitrile derivative corresponding to formula (I) are capable of reacting with one another with a view to obtaining reaction products having a stronger oxidizing effect. Conditions of the type in question prevail in particular when the two reactants meet one another in aqueous solution. This can be achieved by separately adding the peroxygen compound and the "compound" to an optionally detergent-containing solution. However, the process according to the invention is carried out with particular advantage using a dishwashing detergent according to the invention which contains the bleach-activating "compound" and optionally a peroxygen-containing oxidizing agent preferably selected from the group consisting of organic peracids, hydrogen peroxide, perborate and percarbonate and mixtures thereof. The peroxygen compound may even be separately added to the solution either as such or preferably in the form of an aqueous solution or suspension in cases where a peroxide-free detergent is used.

The conditions may be varied within wide limits, depending on the application envisaged. Thus, besides pure aqueous solutions, mixtures of water and suitable organic solvents may also be used as the reaction medium. The quantities of peroxygen compounds used are generally selected so that the solutions contain between 10 ppm and 10% of active oxygen and preferably between 50 ppm and 5,000 ppm of active oxygen. The quantity of bleach-activating acetonitrile derivative used also depends on the application envisaged. Depending on the required degree of activation, between 0.00001 mole and 0.25 mole and preferably between 0.001 mole and 0.02 mole of activator is used per mole of peroxygen compound, although larger or smaller quantities may also be used in special cases.

The present invention also relates to a dishwashing detergent containing 1% by weight to 10% by weight and, more particularly, 3% by weight to 6% by weight of a compound obtainable by the process according to the invention in addition to typical ingredients compatible with the compound corresponding to formula I.

Besides the bleach activator used in accordance with the invention, the detergents according to the invention, which may be present as powder-form or tablet-form solids or other shaped bodies, may in principle contain any of the known ingredients typically encountered in such detergents. More particularly, the detergents according to the invention may contain builders, surfactants, peroxygen compounds, water-miscible organic solvents, enzymes, sequestering agents, electrolytes, pH regulators and other auxiliaries, such as silver corrosion inhibitors, foam regulators, additional bleach boosters and dyes and fragrances.

In addition, a detergent according to the invention may contain abrasive ingredients, more especially from the group consisting of silica flours, wood flours, polymer powders, chalks and glass microbeads and mixtures thereof. Abrasives are present in the detergents according to the invention in quantities of preferably not more than 20% by weight and, more particularly, in quantities of 5% by weight to 15% by weight.

The present invention also relates to a machine dishwashing detergent containing 15% by weight to 70% by weight and, more especially, 20% by weight to 60% by weight of a water-soluble builder component, 5% by weight to 25% by weight and, more especially, 8% by weight to 17% by weight of an oxygen-based bleaching agent, based on the detergent as a whole, characterized in that it contains a compound obtainable by the process according to the invention, more especially in quantities of 3% by weight to 6% by weight. A detergent of the type in question is preferably a low-alkalinity detergent, i.e. a 1% by weight solution of the detergent has a pH value of 8 to 11.5 and, more particularly, in the range from 9 to 11.

In principle, the water-soluble builder component, more especially in low-alkalinity machine dishwashing detergents of the type in question, may be selected from any of the builders typically used in machine dishwashing detergents, for example alkali metal phosphates which may be present in the form of their alkaline, neutral or acidic sodium or potassium salts. Examples of such alkali metal phosphates are trisodium phosphate, tetrasodium diphosphate, disodium dihydrogen diphosphate, pentasodium triphosphate, so-called sodium hexametaphosphate, oligomeric trisodium phosphate with degrees of oligomerization of 5 to 1,000 and, more particularly, 5 to 50, and mixtures of sodium and potassium salts. They may be present in quantities of up to about 55% by weight, based on the detergent as a whole. Other possible water-soluble builder components are, for example, organic polymers of native or synthetic origin, above all polycarboxylates which act as co-builders, particularly in hard water areas. Examples of builders such as these are, for example, polyacrylic acids and copolymers of maleic anhydride and acrylic acid and the sodium salts of these polymer acids. Commercially available products are, for example, Sokalan® CP 5, CP 10 and PA 30 (BASF). The polymers of native origin suitable as co-builders include, for example, the oxidized starches known, for example, from International patent application WO 94/05762 and polyamino acids, such as polyglutamic acid or polyaspartic acid. Other possible builder components are naturally occurring hydroxycarboxylic acids such as, for example, mono- and dihydroxysuccinic acid, α-hydroxypropionic acid and gluconic acid. Preferred builder components are the salts of citric acid, more especially sodium citrate. The sodium citrate used may be anhydrous sodium citrate and is preferably trisodium citrate dihydrate. Trisodium citrate dihydrate may be used as a fine or coarse crystalline powder. The acids corresponding to the co-builder salts mentioned may also be at least partly present, depending on the pH value ultimately established in the detergents according to the invention.

Suitable oxygen-based bleaching agents are, above all, alkali metal perborate monohydrate and tetrahydrate and/or alkali metal percarbonate and alkali metal persulfates, persilicates and percitrates, sodium being the preferred alkali metal. The use of sodium percarbonate has advantages, especially in dishwashing detergents, because it has a particularly favorable effect on the corrosion behavior of glasses. Accordingly, the oxygen-based bleaching agent is preferably an alkali metal percarbonate, more especially sodium percarbonate. Known peroxycarboxylic acids, for example dodecane diperacid, or phthalimidopercarboxylic acids which may optionally be substituted at the aromatic radical may be present in addition to or, more particularly, as an alternative to the oxygen-based bleaching agent. Moreover, the addition of small quantities of known bleach stabilizers, for example phosphonates, borates and metaborates and metasilicates and also magnesium salts, such as magnesium sulfate, can be useful.

In addition to the bleach-activating acetonitrile derivative compounds, known conventional bleach activators, i.e. compounds which form aliphatic peroxocarboxylic acids preferably containing 1 to 10 carbon atoms and, more particularly, 2 to 4 carbon atoms and/or optionally substituted perbenzoic acid under perhydrolysis conditions, may be used. Suitable conventional bleach activators are substances which carry O- and/or N-acyl groups with the number of carbon atoms mentioned and/or optionally substituted benzoyl groups. Preferred conventional bleach activators are polyacylated alkylenediamines, more especially tetraacetyl ethylenediamine (TAED), acylated triazine derivatives, more especially 1,5-diacetyl-2,4-dioxohexahydro-1,3,5-triazine (DADHT), acylated glycolurils, more especially tetraacetyl glycoluril (TAGU), N-acyl imides, more especially N-nonanoyl succinimide (NOSI), carboxylic anhydrides, more especially phthalic anhydride, acylated polyhydric alcohols, more especially triacetin, ethylene glycol diacetate, 2,5-diacetoxy-2,5-dihydrofuran and the enol esters known from German patent applications DE 196 16 693 and DE 196 16 767 and also acetylated sorbitol and mannitol and the mixtures thereof (SORMAN) described in European patent application EP 0 525 239, acylated sugar derivatives, more especially pentaacetyl glucose (PAG), pentaacetyl fructose, tetraacetyl xylose and octaacetyl lactose and acetylated, optionally N-alkylated, glucamine and gluconolactone, and/or the N-acylated lactams, for example N-benzoyl caprolactam, which are known from International patent applications WO 94/27970, WO 94/28102, WO 94/28103, WO 95/00626, WO 95/14759 and WO 95/17498. The hydrophilically substituted acyl acetals known from German patent application DE 196 16 769 and the acyl lactams described in German patent application DE 196 16 770 and in International patent application WO 95/14075 are also preferably used. The combinations of conventional bleach activators known from German patent application DE 44 43 177 may also be used. Conventional bleach activators such as these are present in the usual quantities, preferably in quantities of 0.1% by weight to 10% by weight and more preferably in quantities of 0.5% by weight to 7% by weight, based on the detergent as a whole.

In addition to or instead of the conventional bleach activators mentioned above, the sulfonimines known from European patents EP 0 446 982 and EP 0 453 003 and/or bleach-boosting transition metal salts or transition metal complexes may be present as so-called bleach catalysts. Suitable transition metal compounds include in particular the manganese-, iron-, cobalt-, ruthenium- or molybdenumsalen complexes known from German patent application DE 195 29 905 and the N-analog compounds thereof known from German patent application DE 196 20 267, the manganese-, iron-, cobalt-, ruthenium- or molybdenum-carbonyl complexes known from German patent application DE 195 36 082, the manganese, iron, cobalt, ruthenium, molybdenum, titanium, vanadium and copper complexes with nitrogen-containing tripod ligands described in German patent application DE 196 05 688, the cobalt-, iron-, copper- and ruthenium-ammine complexes known from German patent application DE 196 20 411, the manganese, copper and cobalt complexes described in German patent application DE 44 16 438, the cobalt complexes described in European patent application EP 0 272 030, the manganese complexes known from European patent application EP 0 693 550, the manganese, iron, cobalt and copper complexes known from European patent EP 0 392 592 and/or the manganese complexes described in European patent EP 0 443 651 or in European patent applications EP 0 458 397, EP 0 458 398, EP 0 549 271, EP 0 549 272, EP 0 544 490 and EP 0 544 519. Combinations of bleach activators and transition metal bleach catalysts are known, for example, from German patent application DE 196 13 103 and International patent application WO 95/27775. Bleach-boosting transition metal salts and/or complexes, more particularly containing the central atoms Mn, Fe, Co, Cu, Mo, V, Ti and/or Ru, are used in typical quantities, preferably in quantities of up to 1% by weight, more preferably in quantities of 0.0025% by weight to 0.5% by weight and most preferably in quantities of 0.01% by weight to 0.1% by weight, based on the detergent as a whole. Particularly preferred bleach catalyst complexes include cobalt-, iron-, copper- and ruthenium-ammine complexes, for example $[Co(NH_3)_5Cl]Cl_2$ and/or $[Co(NH_3)_5NO_2]Cl_2$.

The machine dishwashing detergents according to the invention preferably contain the usual alkalinity sources, for example alkali metal silicates, alkali metal carbonates and/or alkali metal hydrogen carbonates. The alkalinity sources normally used include carbonates, hydrogen carbonates and alkali metal silicates with a molar $SiO_2$:$M_2O$ ratio (M=alkali metal atom) of 1:1 to 2.5:1. Alkali metal silicates may be present in quantities of up to 40% by weight, based on the detergent as a whole. However, the highly alkaline metasilicates are preferably not used at all as alkalinity sources. The alkalinity source system preferably used in the detergents according to the invention is a mixture of carbonate and hydrogen carbonate, preferably sodium carbonate and hydrogen carbonate, which is present in a quantity of up to 50% by weight and preferably in quantity of 5% by weight to 40% by weight. The ratio of carbonate used to hydrogen carbonate used varies according to the pH value ultimately required.

In another embodiment, the detergents according to the invention contain 20% by weight to 60% by weight of water-soluble organic builder, more especially alkali metal citrate, 3% by weight to 20% by weight of alkali metal carbonate and 5% by weight to 40% by weight of alkali metal disilicate.

Anionic, nonionic and/or amphoteric surfactants, more especially low-foaming nonionic surfactants, may also be added to the detergents according to the invention to improve the removal of fatty-containing soils, as wetting agents and optionally as granulation aids in the production of the detergents. They may be added in quantities of up to 20% by weight, preferably in quantities of up to 10% by weight and more preferably in quantities of 0.5% by weight to 5% by weight. Extremely low-foaming compounds are normally used, especially in machine dishwashing detergents. Such compounds are preferably $C_{12-18}$ alkyl polyethylene glycol polypropylene glycol ethers containing up to 8 moles of ethylene oxide units and up to 8 moles of propylene oxide units in the molecule. However, other known low-foaming nonionic surfactants may also be used, including for example $C_{12-18}$ alkyl polyethylene glycol polybutylene glycol ethers containing up to 8 moles of ethylene oxide units and up to 8 moles of butylene oxide units in the molecule, end-capped alkyl polyalkylene glycol mixed ethers and the foaming, but ecologically attractive $C_{8-14}$ alkyl polyglucosides with a degree of polymerization of about 1 to 4 (for example APG® 225 and APG® 600 of Henkel KGaA) and/or $C_{12-14}$ alkyl polyethylene glycols containing 3 to 8 ethylene oxide units in the molecule. Surfactants from the glucamide family, for example alkyl-N-methyl glucamides in which the alkyl moiety preferably emanates from a $C_{6-14}$ fatty alcohol, are also suitable. The described surfactants may also be advantageously used in the form of mixtures, for example in the form of a mixture of alkyl polyglycoside with fatty alcohol ethoxylates or a mixture of glucamide with alkyl polyglycosides.

If desired, the dishwashing detergents according to the invention may contain silver corrosion inhibitors. Preferred silver corrosion inhibitors are organic sulfides, such as cystine and cysteine, dihydric or trihydric phenols, optionally alkyl-, aminoalkyl- or aryl-substituted triazoles, such as benzotriazole, isocyanuric acid, manganese, cobalt, titanium, zirconium, hafnium, vanadium or cerium salts and/or complexes in which the metals mentioned have the oxidation number II, III, IV, V or VI, depending on the metal. The content of silver corrosion inhibitors in the detergents according to the invention is preferably in the range from 0.01% by weight to 1.5% by weight and more preferably in the range from 0.1% by weight to 0.5% by weight. Thus, the manganese(III) or manganese(IV) complexes known from International patent application WO 94/19445, the cysteine disclosed as a silver protector in the International patent application WO 94/07981, the cystine described in German patent application DE 195 18 693 as having a silver-corrosion-inhibiting effect either on its own or, in particular, in combination with isocyanuric acid and/or the titanium, zirconium, hafnium, vanadium, cobalt or cerium salts and/or complexes described in German patent applications DE 43 25 922 or DE 43 15 397, in which the metals have the oxidation number II, III, IV, V or VI, and the manganese(II) salts or complexes mentioned in those patent applications may be used in the detergents according to the invention to prevent the corrosion of silver.

The detergents according to the invention may additionally contain enzymes, such as proteases, amylases, pullulanases, cutinases and lipases, for example proteases, such as BLAP®, Optimase®, Opticlean®, Maxacal®, Maxapem®, Esperase®, Savinase®, Purafect® OxP and/or Durazym®, amylases, such as Termamyl®, Amylase-LT®, Maxamyl®, Duramyl® and/or Purafect® OxAm, lipases, such as Lipolase®, Lipomax®, Lumafast® and/or Lipozym®. The enzymes optionally used may be adsorbed onto supports and/or encapsulated in shell-forming substances to protect them against premature inactivation, as described for example in International patent applications WO 92/11347 or WO 94/23005. They are present in the detergents according to the invention in quantities of preferably up to 2% by weight and more preferably in quantities of 0.1% by weight to 1.5% by weight, enzymes stabilized against oxidative degradation, as known for example from International patent applications WO 94/02597, WO 94/02618, WO 94/18314, WO 94/23053 or WO 95/07350, being particularly preferred.

If the detergents foam too vigorously in use, preferably up to 6% by weight and more preferably about 0.5% by weight to 4% by weight of a foam-suppressing compound, preferably from the group of silicone oils, mixtures of silicone oil and hydrophobicized silica, paraffins, paraffin/alcohol combinations, hydrophobicized silica, bis-fatty acid amides and other known commercially available defoamers, may be added to them. Other optional ingredients in the detergents according to the invention are, for example, perfume oils.

In order to establish a desired pH value which is not automatically established under in-use conditions by the mixture of the other components, the detergents according to the invention may contain system-compatible and environmentally compatible acids, more particularly citric acid, acetic acid, tartaric acid, malic acid, lactic acid, glycolic acid, succinic acid, glutaric acid and/or adipic acid and also mineral acids, more especially sulfuric acid, or alkali metal hydrogen sulfates or bases, more especially ammonium or alkali metal hydroxides. pH regulators such as these may be present in the detergents according to the invention in quantities of preferably not more than 10% by weight and, more preferably, in quantities of 0.5% by weight to 6% by weight.

The detergents according to the invention are preferably present as powder-form, granular or tablet-form preparations which can be produced in known manner, for example by mixing, granulation, roll compacting and/or by spray drying of the heat-resistant components and adding the more sensitive components, including in particular enzymes, bleaching agents and the bleach-activating compound.

Detergents according to the invention in tablet form are preferably produced by mixing all the ingredients together in a mixer and tabletting the resulting mixture in conventional tablet presses, for example eccentric or rotary presses, using pressures of $200 \cdot 10^5$ Pa to $1500 \cdot 10^5$ Pa. Fracture-resistant tablets with flexural strengths of normally above 150 N, which still dissolve sufficient quickly under in-use conditions, are readily obtained in this way. A tablet thus produced preferably has a weight of 15 g to 40 g and more particularly 20 g to 30 g for a diameter of 35 mm to 40 mm.

Detergents according to the invention in the form of dust-free, storage-stable and free-flowing powders andlor granules with high bulk densities of 800 to 1000 g/l can be produced by mixing the builder components with at least part of the liquid components in a first stage in which the bulk density of the resulting premix is also increased and then combining the other components of the detergent, including the bleach-activating compound, with the premix thus obtained, if desired after drying.

Dishwashing detergents according to the invention may be used both in domestic dishwashing machines and in institutional dishwashing machines. They are added by hand or by suitable dispensers. The concentrations in which they are used in the wash liquor generally amount to between about 1 and 8 g/l and preferably to between 2 and 5 g/l.

A machine dishwashing program is generally augmented and terminated by a few rinse cycles with clear water after the main wash cycle and a final rinse with a conventional rinse aid. After drying, completely clean and hygienically satisfactory tableware is obtained using detergents according to the invention.

EXAMPLES 25 kg of a 50% N-methyl morpholinium acetonitrile methosulfate solution in water (Sokalan® BM, a product of BASF) and 25 kg of sodium sulfate were introduced into an Eirich® R08 reactor (Evactherm® process). This was followed by drying with superheated steam for 37 minutes under a pressure of 400 mbar. The product temperature was between 69° C. and 96° C. During this drying step, methanol was also removed from the solution so that the methosulfate was converted into the hydrogen sulfate. A melt was present at the end of the drying step. The mixer was evacuated to 50 mbar and cooled. The melt solidified at ca. 55° C. and was converted into granules by the mixer tools.

The granules had a bulk density of 1100 g/l and a water content of 5.3% by weight. The particle spectrum was as follows: 38%>1.6 mm, 42%>0.8 mm to 1.6 mm and 20%>0.4 mm to 0.8 mm. For the use of the granules in the detergent formulation according to Table 1 below, the particle fraction between 0.6 mm and 1.6 mm was removed by sieving.

To produce standardized tea stains, tea cups were dipped 25 times into a tea solution heated to 70° C. A little of the tea solution was then poured into each cup, followed by drying in a drying cabinet. Eight of the tea-stained cups were washed in a Miele® G 590 dishwasher (water hardness ca. 17° dH, operating temperature 55° C.) and stain removal was visually evaluated on a scale of 0 (=unchanged, very thick tea film) to 10 (=no tea film). 20 g of the detergent formulation was used as standard. 1 g of the compounds produced as described above was additionally used in the example according to the invention.

The tea score was significantly higher using the compound produced by the process according to the invention than without the compound.

TABLE 1

| composition of the basic formulation in % by weight | |
|---|---|
| Na tripolyphosphate | 55 |
| Soda | 23 |
| Na perborate monohydrate | 10 |
| Na disilicate | 5 |
| Nonionic surfactant | 2 |
| Enzyme granules | 4 |
| Perfume | 1 |

TABLE 2

| cleaning performance | |
|---|---|
| Detergent | Score |
| 20 g of the basic formulation | 6 |
| 20 g of the basic formulation + 1 g of the compound | 9 |

What is claimed is:

1. A process for the production of a particulate composition that comprises a compound of the general formula (I):

$$R^1R^2R^3N^+CH_2CN\ X^- \quad (I)$$

in which $R^1$, $R^2$ and $R^3$ independently of one another represent an alkyl, alkenyl, or aryl group containing 1 to 18 carbon atoms, wherein $R^2$ and $R^3$ further can form a heterocycle with the quaternary N atom and optionally other hetero atoms, and X is a charge-equalizing anion, said process comprising the steps of a) introducing into a mixer and mixing a suspension comprising a solution of a compound of formula (I) in a solvent for that compound and a solid carrier material;

b) drying the mixture with superheated vapor at a pressure below 900 mbar and at a temperature of 40° C. to below 100° C.;

c) cooling the mixture to a temperature below the drying temperature; and d) forming granules of the mixture during the drying step or during the cooling step to form the particulate composition.

2. The process of claim 1, wherein the solution of the compound of formula (I) comprises 10% by weight to 70% by weight of the compound of formula (I).

3. The process of claim 2, wherein the solution of the compound of formula (I) comprises 40% by weight to 60% by weight of the compound of formula (I).

4. The process of claim 1, wherein the suspension comprises 0.1 parts by weight to 10 parts by weight of carrier material per part by weight of the compound of to formula (I).

5. The process of claim 1, wherein the suspension comprises 0.5 parts by weight to 4 parts by weight of carrier material per part by weight of the compound of formula (I).

6. The process of claim 1, wherein $R^2$ and $R^3$ form a morpholinium ring together with the quaternary N atom.

7. The process of claim 1, wherein $R^1$ is an alkyl group containing 1 to 3 carbon atoms.

8. The process of claim 7, wherein $R^1$ is methyl.

9. The process of claim 1, wherein $X^-$ is a halide.

10. The process of claim 9, wherein $X^-$ is chloride, fluoride, iodide, or bromide.

11. The process of claim 1, wherein $X^-$ is selected from the group consisting of nitrate, hydroxide, hexafluorophosphate, sulfate, hydrogen sulfate, methosulfate, ethosulfate, chlorate, and perchlorate.

12. The process of claim 1, wherein $X^-$ is an anion of a carboxylic acid.

13. The process of claim 12, wherein $X^-$ is formate, acetate, benzoate, or citrate.

14. The process of claim 11, wherein $X^-$ is sulfate, hydrogen sulfate, or methosulfate.

15. The process of claim 1, wherein the solid carrier material is selected from the group consisting of alkali metal sulfates, alkali metal citrates, alkali metal phosphates, silicas, zeolites, and mixtures thereof.

16. The process of claim 1, wherein the pressure in step b) is below 750 mbar.

17. The process of claim 16, wherein the pressure in step b) is 50 mbar to below 650 mbar.

18. The process of claim 1, wherein the superheated vapor is water vapor.

19. The process of claim 1, wherein the superheated vapor is the vapor of an organic solvent.

20. The process of claim 1, further comprising the step of forming a solid detergent comprising the particulate composition.

21. The process of claim 20, wherein the solid detergent is a dishwashing detergent.

22. The process of claim 21, wherein the dishwashing detergent comprises 1% by weight to 10% by weight of the particulate composition.

23. The process of claim 22, wherein the dishwashing detergent comprises 3% by weight to 6% by weight of the particulate composition.

24. The process of claim 22, wherein the dishwashing detergent comprises 15% to 70% by weight of a water-soluble builder component and 5% to 25% by weight of an oxygen-based bleaching agent.

25. The process of claim 24, wherein the dishwashing detergent comprises 20% to 60% by weight of the water-soluble builder component and 8% to 17% by weight of the oxygen-based bleaching agent.

26. The process of claim 25, wherein the dishwashing detergent comprises 3% to 6% by weight of the particulate composition.

27. The process of claim 21, wherein the detergent comprises a peroxygen compound selected from the group consisting of organic peracids, hydrogen peroxide, perborate, percarbonate, and mixtures thereof.

28. The process of claim 21, wherein the detergent comprises 0.5% to 7% by weight of a compound that forms a peroxocarboxylic acids under perhydrolysis conditions.

29. The process of claim 21, wherein the detergent comprises a bleach-catalyzing transition metal salt or complex.

30. The process of claim 29, wherein the detergent comprises 0.0025% to 0.5% by weight of the bleach-catalyzing transition metal salt or complex.

31. The process of claim 29, wherein the bleach-catalyzing complex is a cobalt, iron, copper, or ruthenium ammine complex.

32. The process of claim 31, wherein the the bleach-catalyzing complex is $[Co(NH_3)_5Cl]Cl_2$, $[Co(NH_3)_5NO_2]Cl_2$, or a combination thereof.

* * * * *